US008671803B2

(12) United States Patent
Katsunuma et al.

(10) Patent No.: US 8,671,803 B2
(45) Date of Patent: Mar. 18, 2014

(54) FASTENING TOOL

(75) Inventors: Toshinari Katsunuma, Nisshin (JP); Mikio Hanai, Miyoshi (JP); Yoshitada Arakawa, Toyota (JP); Harutsugu Yoshida, Toyokawa (JP); Jiro Tsukamoto, Nisshin (JP); Nobuyuki Morimoto, Nagoya (JP); Noritsugu Okada, Obu (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 625 days.

(21) Appl. No.: 12/675,332

(22) PCT Filed: Aug. 20, 2008

(86) PCT No.: PCT/JP2008/064796

§ 371 (c)(1),
(2), (4) Date: Apr. 19, 2010

(87) PCT Pub. No.: WO2009/028362

PCT Pub. Date: Mar. 5, 2009

(65) Prior Publication Data

US 2010/0199810 A1 Aug. 12, 2010

(30) Foreign Application Priority Data

Aug. 27, 2007 (JP) ..... 2007-220437

(51) Int. Cl.
*B25B 21/00* (2006.01)

(52) U.S. Cl.
USPC ..... 81/54; 81/55

(58) Field of Classification Search
USPC ..... 81/54, 55, 451, 180.1
See application file for complete search history.

(56) References Cited

U.S. PATENT DOCUMENTS 4,064,952 A * 12/1977 Lechner ..... 175/209

(Continued)

FOREIGN PATENT DOCUMENTS

| | | | |
|---|---|---|---|
| DE | 3612466 | A1 | 10/1987 |
| JP | 53-162500 | U | 12/1978 |
| JP | 56-83374 | U | 7/1981 |
| JP | 56-98579 | U | 8/1981 |

(Continued)

OTHER PUBLICATIONS

Extended European Search Report of EP 08 79 2567 mailed Aug. 23, 2011.

*Primary Examiner* — Robert Scruggs
(74) *Attorney, Agent, or Firm* — Kenyon & Kenyon LLP

(57) ABSTRACT

When bolts are fastened to tack a door to a car body by means of a conventional impact wrench, the shavings stick to the surface of the door or car body, thereby to cause the poor coating quality such as a seeding when the inter-coating or finish-coating is performed in the coating procedure. An impact wrench provided is a fastening tool for fastening a bolt gripped by a socket, in a nut. The impact wrench includes a suction cover for covering the surroundings of the socket, and a suction port capable of sucking the atmosphere in the portion covered with the suction cover, and is constituted such that the atmosphere in the suction cover is sucked through the suction port to recover the shavings left at the time of fastening the bolt. This constitution makes it possible to prevent the shavings from being scattered to the surroundings. When the door is temporarily attached at the coating step to a car body, the poor coating quality such as the seeding, as might otherwise be caused by the shavings stuck to the surface of the car body or door, can be prevented and improved.

4 Claims, 6 Drawing Sheets

(56) References Cited

U.S. PATENT DOCUMENTS

| | | | | |
|---|---|---|---|---|
| 4,593,583 | A * | 6/1986 | Singleton | 81/57.14 |
| 4,924,732 | A | 5/1990 | Hoskins et al. | |
| 6,418,818 | B1 * | 7/2002 | Tham et al. | 81/54 |
| 7,425,109 | B2 * | 9/2008 | Simm et al. | 408/67 |
| 2002/0154960 | A1 * | 10/2002 | Lin | 408/67 |
| 2010/0269647 | A1 * | 10/2010 | Baumann et al. | 81/489 |

FOREIGN PATENT DOCUMENTS

| | | | |
|---|---|---|---|
| JP | 62-114885 | A | 5/1987 |
| JP | 63-60520 | U | 4/1988 |
| JP | 01-138711 | U | 9/1989 |
| JP | 05-74770 | U | 10/1993 |
| JP | 2002-046075 | A | 2/2002 |
| JP | 2007-220436 | A | 8/2007 |
| JP | 2009-052679 | A | 3/2009 |

* cited by examiner

FASTENING TOOL

This is a 371 national phase application of PCT/JP2008/064796 filed 20 Aug. 2008, claiming priority to Japanese Patent Application No. 2007-220437 filed 27 Aug. 2007, the contents of which are incorporated herein by reference.

FIELD OF THE INVENTION

The present invention relates to a fastening tool for fastening a gripped fastening member to a fastened member.

BACKGROUND OF THE INVENTION

In the popular product line of vehicles, after coating the vehicle body, the components are assembled to the body. In a coating step, with the door such as a front door or rear door separated from the body, the electrodeposition coatings are performed to the body and door, and temporarily attaching the door to the body, the second coating and finish coating are carried out to the body and door.

In such a case, in a subsequent assembling step, the door is detached and assembled to the body.

The door is bolted to the body when temporarily attached and assembled to the body, in which used for bolting is the fastening tool such as an impact wrench disclosed in JP H5-74770 U.

When fastening the bolt to the nut set in the body and temporarily attaching the door to the body, the flange formed at the bolt head has a contact with the door-side members having the electrodeposition coating film, whereby the coating film is shaved off and the shavings occur.

The nut arranged in the body also has the electrodeposition coating film, so that the bolt shaves the coating film, thereby causing the shavings.

Fastening the bolt in the nut is, for example, performed in such a way that the socket of the wrench covers and grips the bolt head, and the socket rotates. In the case, the shavings may occur by the contact of the socket with the bolt head.

Thus, when fastening the bolt using the fastening tool such as an impact wrench for attaching the door to the body, many shavings occur around the bolted portion.

On the other hand, in the coating step, in order to avoid the poor coating quality (e.g. seeding) caused by the coating such as second coating or finish coating with the dust adhered to the surface of the body or door, the coating operation is carried out in a clean environment such as in a clean room.

However, as mentioned above, the shavings occur when tacking the door to the body, and the shavings adhere to the surface of the body or door, which causes the imperfect coating such as the seeding in second coating or finish coating, so that it is preferable to avoid the adhesion of the shavings to the surfaces of the body and door when fastening the bolt in the nut for temporarily attaching the door to the body.

SUMMARY OF INVENTION

Problems to be Solved by the Invention

The objective of the present invention is to provide an unexpected fastening tool enabled to avoid adhering of the shavings, which are generated by fastening the bolt in the nut when attaching the work to the body, to the surfaces of the work and the body.

Means of Solving the Problems

The present invention is a fastening tool fastening a fastening member supported by a gripping member to a fastened member, and includes a cover for covering around the gripping member and a suction port for sucking an atmosphere surrounded by the cover, in which the gripping member rotates in a direction of fastening the fastening member, the gripping member comprises an internal opening formed in a shape in response to a head portion of the fastening member, the gripping member comprises a through hole communicating an inner side of the internal opening to an outer side thereof, and when fastening the fastening member, the internal opening is fitted to the head portion of the fastening member and the through hole faces the side of the head portion fitted in the internal opening.

The above structure allows sucking the atmosphere in the cover and to collect the shavings generated in fastening the fastening member through the suction port, thereby preventing the shavings from scattering around.

Therefore, at the coating step for the vehicle, when the door is temporarily attached by means of the fastening member to the body with which the fastened member is provided, the poor coating quality such as the seeding caused by the shavings adhered to the surface of the body or door can be prevented and the coating quality can be improved.

Furthermore, the above structure allows sucking the shavings generated in the area surrounded by the inner side of the gripping member via the through hole, thereby improving the collection efficiency for the shavings.

In the preferable embodiment of the present invention, the through hole is formed in a direction perpendicular to the rotating axis of the gripping member and the formed direction of the hole is inclined to an opposite side to the rotating direction with respect to a radiating direction from a rotation center of the gripping member.

Thus, it causes the shavings generated in the socket to enter the through hole and to be discharged through the through hole, thereby collecting the shavings efficiently.

In the other embodiment of the present invention, the wrench further includes a fan for generating airflow toward the suction port, arranged in the cover.

Thus, increasing the suction performance in the suction cover toward the port, the efficiency for collecting the shavings generated at the fastening of the bolt is improved.

Effect of the Invention

According to the present invention, prevented is the scattering of the shavings caused by the fastening of the fastening member to the fastened member.

Thus, at the coating step for the vehicle, when the door is temporarily attached by means of the fastening member to the body with which the fastened member is provided, the poor coating quality such as the seeding caused by the shavings adhered to the surface of the body or door can be prevented and the coating quality can be improved.

DETAILED DESCRIPTION

The best mode for carrying out the present invention is described below, referring attached drawings.

Figure 1:
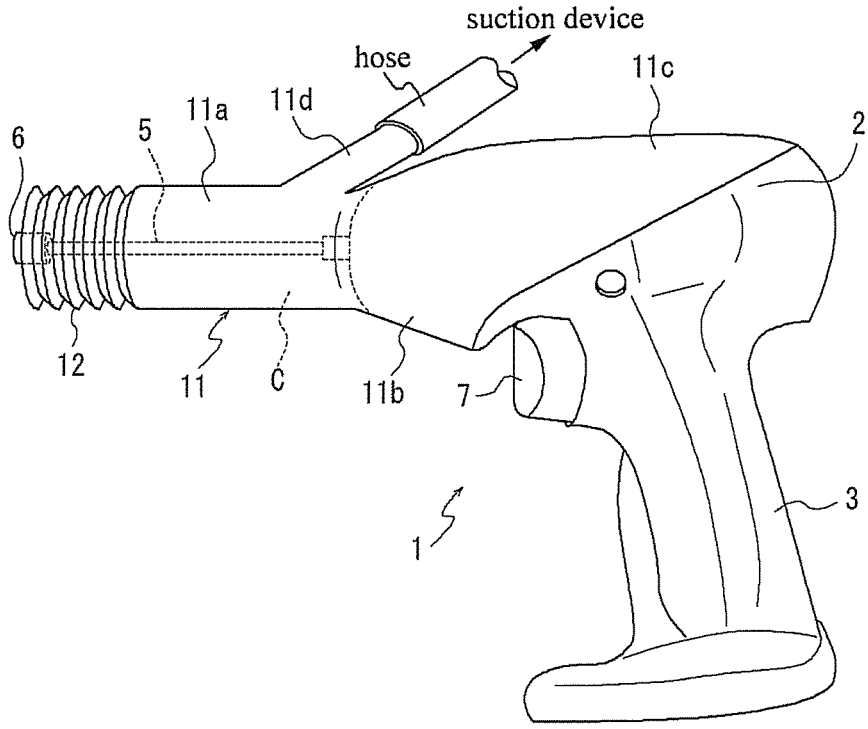
FIG. 1 is a perspective view illustrating an impact wrench as one embodiment of the fastening tool.

FIG. 1 shows an impact wrench 1 as a fastening tool fastening a fastening member such as a bolt to a fastened member such as a nut, including a socket 6 for gripping the fastening member, a body 2 for supporting the socket 6 rotatably via a rotating shaft 5, and a grip 3 extending from the body 2 for the operator to hold the wrench 1.

The body 2 has a motor connected to the shaft 5 for driving the socket 6, and the grip 3 has a trigger 7 for switching the drive of the motor.

In the wrench 1, the rotating axis of the socket 6 (that is the axis of the shaft 5) is the same as the longitudinal direction (left and right direction in FIG. 1) of the body 2.

The outer periphery of the body 2 is covered with a body cover 11 from the side of the socket 6 (head portion) to the side of the grip 3 (base portion).

Figure 2:
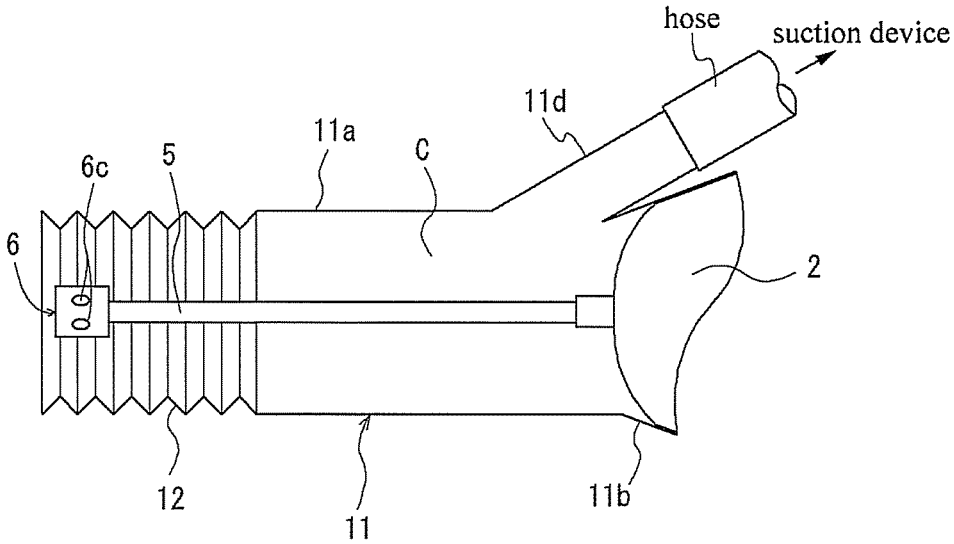
FIG. 2 is a sectional side view showing the head portion of the wrench covered with a body cover and a suction cover.

As shown in FIG. 2, the cover 11 is stuck to the body 2 at the middle 11*b* and the base end 11*c*, whereby the sealing is secured between the body 2 and the cover 11.

The cover 11 extends the leading end 11*a* from the body 2 toward the socket 6, covering the surroundings of the shaft 5 with defining a space C around the shaft 5.

The cover 11 is opened at the leading end.

The cover 11 has rigidity to a certain extent in that the cover maintains the shape self-supportingly, and has elasticity to a certain extent in that the sealing is secured between the body 2 and the cover 11 when stuck to the body 2, for example the material of the cover 11 is the polyvinyl chloride.

The end 11*a* of the cover 11 is connected with a suction cover 12 extending toward the socket 6 and having a tubular shape at the tip thereof.

The suction cover 12 has a certain length from the end 11*a* of the cover 11 to the tip of the socket 6 or beyond the tip of the socket 6, thereby the suction cover covering the tip of the shaft 5 and the periphery of the socket 6.

In the embodiment, the end 11*a* of the cover 11 may be extended to the tip of the shaft 5 so that the suction cover 12 only covers the socket 6.

Note that the suction cover 12 has a bellows structure stretching in the axis direction of the shaft 5.

The end 11*a* of the cover 11, which is arranged to form the space C around the shaft 5, has a suction port 11*d* for sucking the atmosphere in the space C.

The suction port 11*d* may be connected with the hose communicated with the suction device, thereby being capable of sucking the atmosphere in the space C.

The space C is communicated with the inside surrounded by the suction cover 12, so that suction through the suction port 11*d* makes it possible to suck the atmosphere in the cover 12.

Figure 3:
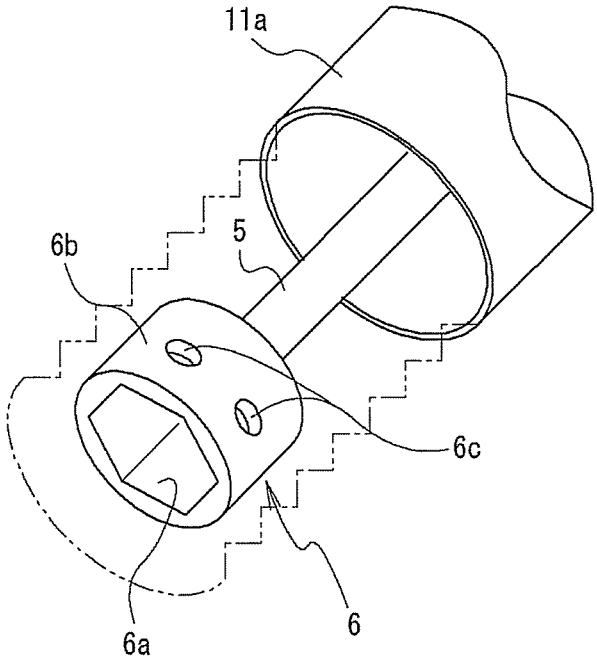
FIG. 3 is a perspective view illustrating a socket arranged in the head portion of the wrench.

As depicted in FIG. 3, the socket 6 has an internal opening 6*a*, which is formed in accordance with the bolt head to be engaged with the bolt head, and the socket 6 supports the bolt head fitted therein.

In this manner, the socket 6 grips the bolt head and rotates together with it.

The socket 6 has through holes 6*c* at the sides thereof, and the holes communicate the inner side of the opening 6*a* to the outer side 6*b* of the socket 6. The holes 6*c* is drilled in the orthogonal direction to the rotating axis of the socket 6.

Figure 4:
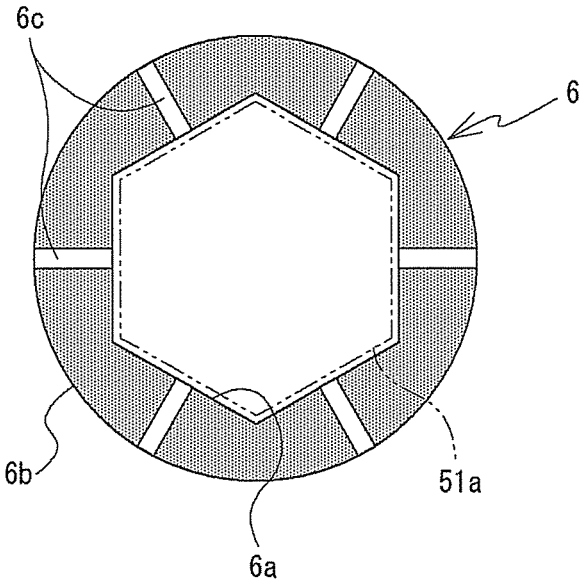
FIG. 4 is a front view showing through holes formed in the socket.

As shown in FIG. 4, the socket 6 fastens the hexagon-headed bolt, and the opening 6*a* is formed in hexagonal shape in response to the shape of the head 51*a* of the bolt.

The holes 6*c* are formed in each side of the inner wall of the opening 6*a*, and the formed direction of each hole 6*c* is radiated from the rotation center of the socket 6.

Figure 5:
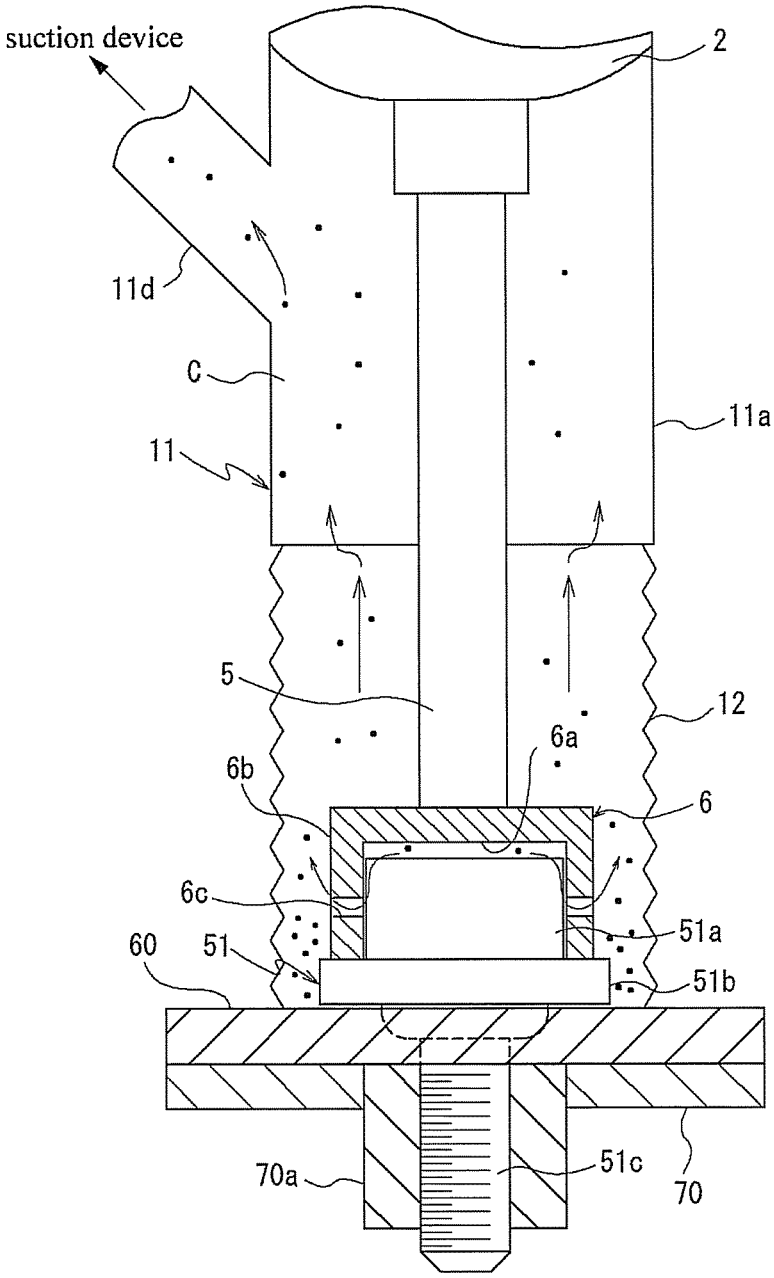
FIG. 5 is a sectional side view showing the wrench sucking the shavings generated at fastening the bolt to the nut.

In one embodiment shown in FIG. 5, when the door is attached to the body using the bolt 51, the screw portion 51*c* of the bolt 51 is inserted into the hinge 60 of the door and the bolt 51 is fastened to the nut 70*a* of the body 70, whereby the door is attached to the body 70 via the hinge 60.

As mentioned above, when fastening the bolt 51 to the nut 70*a*, the impact wrench 1 is used to fasten the bolt 51 as follows.

The opening 6*a* of the socket 6 is engaged with the head 51*a* of the bolt 51, and pushing the trigger 7 makes the socket 6 rotated by the motor in the body 2. In cooperated with the rotation of the socket 6, the bolt 51 rotates to be fastened to the nut 70*a*.

The hinge 60 is fastened to the body 70, so that the door is attached to the body 70.

Note that the door (including the hinge 60) and the body (including the nut 70*a*) have electrodepostion coating films.

When the wrench 1 fastens the bolt 51 and the door is attached to the body 70 having the coating film, the screw portion 51*c* of the bolt 51 shaves the coating film of the nut 70*a* of the body 70, and at the same time, the flange 51*b* provided with the head 51*a* of the bolt 51 has a contact with the body 70, so that the coating film of the body 70 is shaved off for generating the shavings at the side of the head 51*a* of the bolt 51.

If the shavings scatter and adhere to the surfaces of the body 70 and the door, the poor coating quality such as the seeding occurs when performing the second coating or the finish coating at the coating step, so that the wrench 1 easily collects the shavings generated in fastening the bolt 51 to the nut 70*a* so as not to scatter around.

When the wrench 1 fastens the bolt 51 to the nut 70*a*, the opening 6*a* of the socket 6 engages with the head 51*a* of the bolt 51 and the socket 6 is rotated, at the time that the socket 6 covers the bolt 51, the tip of the cover 12 is contacted to the hinge 60.

Mentioned above, the suction cover 12 has the certain length from the end 11*a* of the body cover 11 to the tip of the socket 6 or beyond the tip of the socket 6, so that the tip of the suction cover 12 contacts to the hinge 60 and the suction cover 12 covers the head 51*a* of the bolt 51 and the socket 6 engaged with the head 51*a*.

When fastening the bolt 51, the atmosphere surrounding the socket 6 and the other members is sucked through the port 11*d* connected with the suction device.

The socket 6 and the surroundings are covered with the suction cover 12 and the atmosphere in the suction cover 12 is sucked when fastening the bolt 51, as a result, the shavings generated at the side of the head 51*a* of the bolt 51 is are sucked through the port 11*d*, thereby preventing the scattering around.

In such a case, the socket 6 has the holes 6*c*, so that the shavings generated in the opening 6*a* of the socket 6 caused by the contact of the socket 6 to the head 51*a* of the bolt 51 are removed from the socket 6 through the holes 6*c* and sucked through the port 11*d* as well as the shavings generated at the periphery of the socket 6.

The shavings sucked through the port 11*d* are collected by the suction device or captured by the filter disposed between the port 11*d* and the suction device.

The suction device for sucking the atmosphere surrounded by the suction cover 12 through the port 11*d* may be employed by a wondergun connected to the air pipes in the factory where the coating step is performed.

The wondergun utilizes the back pressure generated by the air in the air pipes to suck the atmosphere in the suction cover 12 through the hoses connected to the port 11*d*.

As described above, the wrench 1 sucks the atmosphere in the suction cover 12 through the suction port 11*d* and collects the shavings generated when fastening the bolt 51, thereby preventing the scattering of the shavings.

Thus, when temporarily attaching the door to the body 70 at the coating step, the poor coating quality is prevented such as the seeding caused by adhering of the shavings to the body 70 or the door, thereby improving the coating quality.

In the embodiment, the holes 6*c* of the socket 6 are, as shown in FIG. 4, formed as radiated from the rotation center of the socket 6 toward outside, and explained below is the advantageous embodiment of the holes 6*c*.

Figure 6:
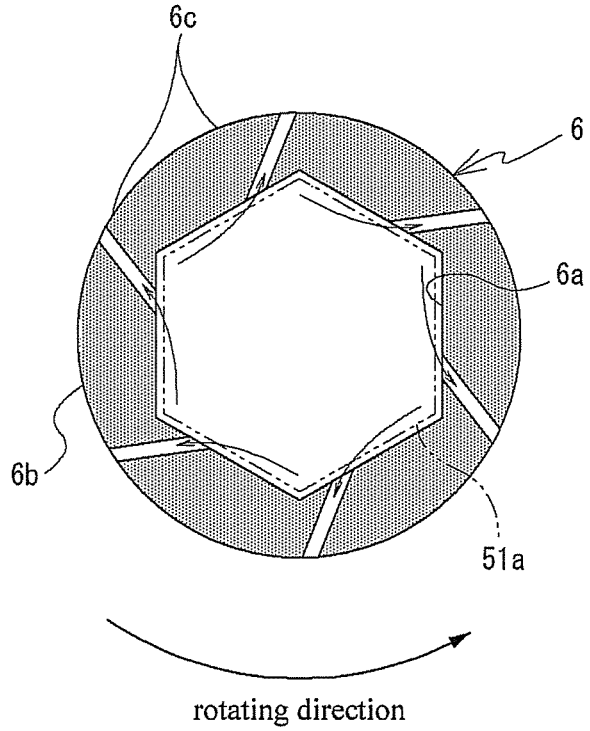
FIG. 6 is a front view showing the other embodiment of the through holes.

For example, as depicted in FIG. 6, the formed directions of the holes are inclined by the angle θ to the opposite side to the rotating direction of the socket 6 with respect to the radiation direction from the center of the rotation axis of the socket 6.

In other words, in this embodiment, the inner ends of the holes 6*c* are shifted toward the rotating direction with respect to the outer end, and the holes 6*c* direct at the directions inclined gradually from inside to outside by the angle θ to the opposite side to the rotating direction of the socket 6 with respect to the radiation direction.

In the above-described embodiment, in which the holes 6*c* are formed as radiated from the rotation center of the socket 6 as shown in FIG. 4, the rotating direction of the socket 6 is perpendicular to the formed directions of the holes 6*c*, so that there may be the case that the shavings generated in the opening 6*a* are not removed through the holes 6*c* and left at the corners of the inside of the opening 6*a*.

In the advantageous embodiment shown in FIG. 6, the formed directions of the holes 6*c* are inclined to the opposite direction to the rotation direction of the socket 6, so that the angle which the rotating direction of the socket 6 and the formed directions of the holes 6*c* make is smaller than right angle; as a result, it becomes easier for the shavings to enter the holes 6*c* in accordance with the rotation of the socket 6, and for the shavings generated in the opening 6*a* to be discharged through the holes 6*c*.

Thus, leaving the shavings in the opening 6*a* of the socket 6 is prevented and the efficient collection of the shavings is provided.

In the preferable embodiment, in order to improve the efficiency for collecting the shavings generated at the fastening of the bolt 51, the wrench 1 may include a fan for blowing toward the port 11*d* in the surrounded area with the suction cover 12.

Figure 7:
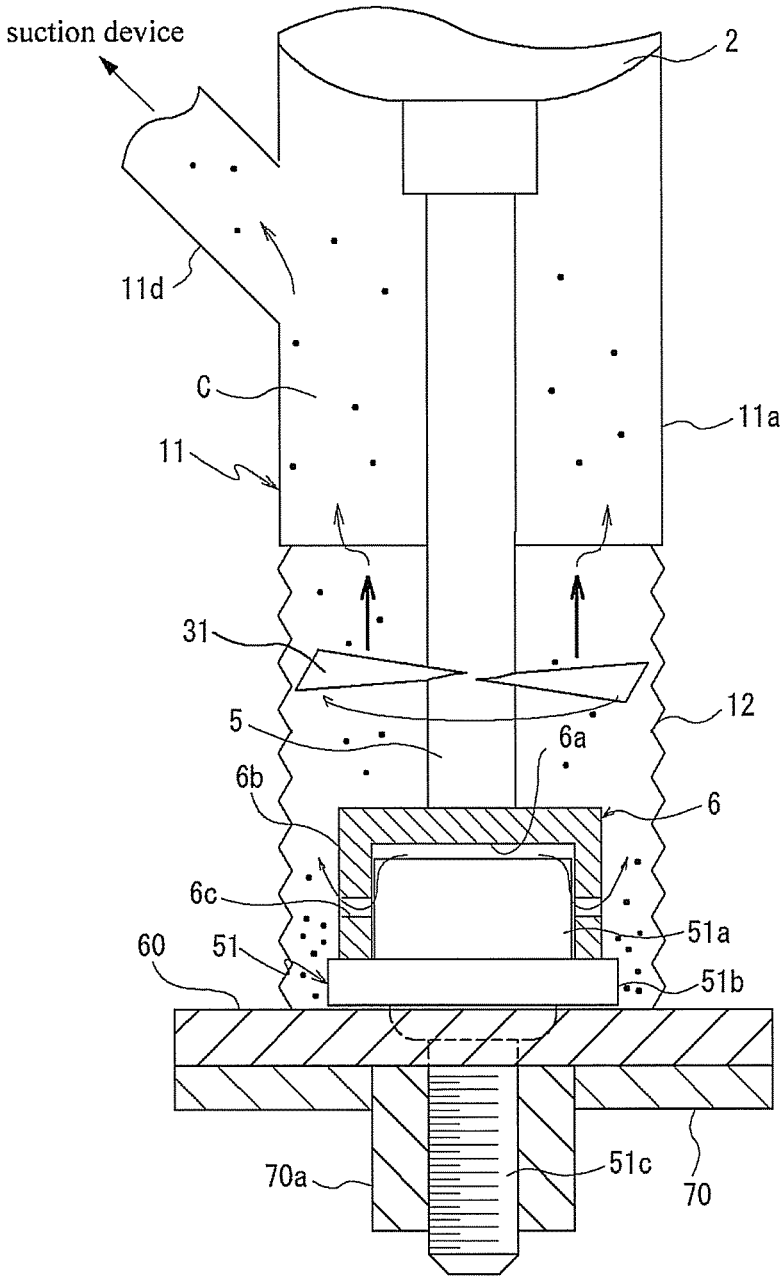
FIG. 7 is a sectional side view showing the other embodiment of the wrench having a fan, provided in the shaft, rotating together with the socket.

For example, as depicted in FIG. 7, the wrench 1 has a fan 31 in the shaft 5, and the fan 31 rotates together with the socket 6.

The fan 31 blows toward the body 2 from the socket 6 in the suction cover 12 when the socket 6 is rotated for fastening the bolt 51, so that the airflow generated by the fan 31 toward the port 11*d* strengthens the airflow generated by the suction at the port 11*d* from the socket 6 to the body 2.

Thus, increasing the suction performance in the suction cover 12 toward the port 11*d*, the efficiency for collecting the shavings generated at the fastening of the bolt 51 is improved.

Figure 8:
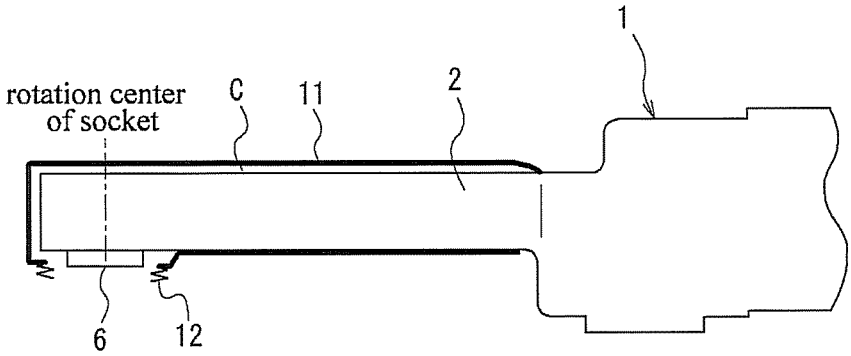
FIG. 8 is a sectional side view showing an impact wrench, in which the rotating axis of the socket is perpendicular to the longitudinal direction of the body.
Figure 9:
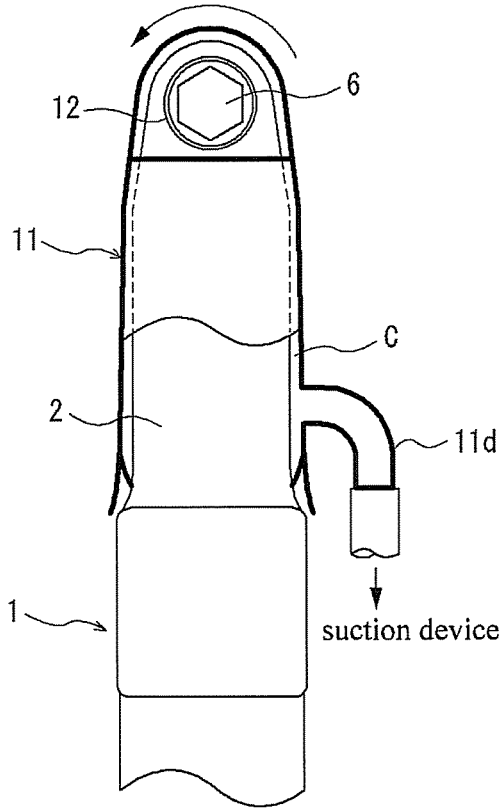
FIG. 9 is a bottom view showing an impact wrench, in which the rotating axis of the socket is perpendicular to the longitudinal direction of the body.

In the wrench 1 as above-described embodiment, the direction of the rotating axis of the socket 6 is the same as the longitudinal direction (left and right direction in FIG. 1) of the body 2, and FIGS. 8, 9 show the wrench 1 as the other embodiment, in which the rotating axis of the socket 6 is orthogonal to the longitudinal direction (left and right direction in FIGS. 8, 9) of the body 2, being capable of collecting the shavings.

In the wrench 1 as depicted in FIGS. 8, 9, the body cover 11 covers the tip of the body 2, and the tip of the cover 11 is connected to the suction cover 12 surrounding the socket 6. The suction cover 12 has the bellows structure as the same as shown in FIGS. 1, 2.

The shavings generated at fastening the bolt 51 is collected by being sucked through the port 11*d* via the space between the suction cover 12 arranged at the tip of the cover 11 and the socket 6 and via the space C defined between the cover 11 and the body 2.

Note that the cover 11 is stuck to the body 2 at the portion positioned closer to the base end than the port 11*d*, and sucking through the port 11*d* allows to suck the atmosphere around the socket 6 covered with the suction cover 12.

INDUSTRIAL APPLICABILITY

The fastening tool according to the present invention is applicable to the fastening tool for fastening the gripped fastening member to the fastened member, especially to the case that the shavings occur in the fastened member when fastening the fastening member to the fastened member.

The invention claimed is:

1. A fastening tool fastening a fastening member supported by a gripping member to a fastened member, comprising:

a cover for covering around the gripping member; and a suction port for sucking an atmosphere surrounded by the cover, wherein the gripping member rotates in a direction of fastening the fastening member, wherein the gripping member comprises an internal opening formed in a shape in response to a head portion of the fastening member, wherein the gripping member comprises a through hole communicating with an inner side of the internal opening to an outer side thereof, and wherein when fastening the fastening member, the internal opening is fitted to the head portion of the fastening member and the through hole faces the side of the head portion fitted in the internal opening.

2. The fastening tool according to claim 1, wherein the through hole is formed such that the formed direction of the hole is inclined to an opposite side to the rotating direction with respect to a radiating direction from a rotation center of the gripping member.

3. The fastening tool according to claim 2, further comprising:

a fan for generating airflow toward the suction port, arranged in the cover.

4. The fastening tool according to claim 1, further comprising:

a fan for generating airflow toward the suction port, arranged in the cover.

* * * * *

UNITED STATES PATENT AND TRADEMARK OFFICE

CERTIFICATE OF CORRECTION

PATENT NO. : 8,671,803 B2
APPLICATION NO. : 12/675332
DATED : March 18, 2014
INVENTOR(S) : Katsunuma et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 674 days.

Signed and Sealed this
Twenty-ninth Day of September, 2015

Michelle K. Lee

Michelle K. Lee
*Director of the United States Patent and Trademark Office*